US010982515B2

(12) United States Patent
Hughes

(10) Patent No.: US 10,982,515 B2
(45) Date of Patent: Apr. 20, 2021

(54) ELECTRIC SUBMERSIBLE HYDRAULIC LIFT PUMP SYSTEM

(71) Applicant: Intrinsic Energy Technology, LLC, Edmond, OK (US)

(72) Inventor: William James Hughes, Highlands Ranch, CO (US)

(73) Assignee: Intrinsic Energy Technology, LLC, Edmond, OK (US)

( * ) Notice: Subject to any disclaimer, the term of this patent is extended or adjusted under 35 U.S.C. 154(b) by 0 days.

(21) Appl. No.: 16/235,206

(22) Filed: Dec. 28, 2018

(65) Prior Publication Data

US 2019/0360316 A1 Nov. 28, 2019

Related U.S. Application Data

(60) Provisional application No. 62/675,364, filed on May 23, 2018.

(51) Int. Cl.
*E21B 43/00* (2006.01)
*E21B 43/12* (2006.01)

(52) U.S. Cl.
CPC ..... *E21B 43/129* (2013.01); *E21B 43/128* (2013.01)

(58) Field of Classification Search
CPC .. F04F 1/08; F04F 1/20; E21B 43/128; E21B 43/129; E21B 43/305; E21B 43/124
See application file for complete search history.

(56) References Cited

U.S. PATENT DOCUMENTS 4,003,678 A 1/1977 David
5,042,297 A * 8/1991 Lessi ..... E21B 43/121 73/152.31
5,960,886 A * 10/1999 Morrow ..... E21B 43/121 166/369
6,120,261 A 9/2000 Al-Towailib
8,303,272 B2 11/2012 Pugh et al.
8,403,059 B2 3/2013 Hughes et al.
2003/0019633 A1 1/2003 Podio
2009/0008088 A1* 1/2009 Schultz ..... E21B 36/02 166/249
2014/0205469 A1* 7/2014 Lindsay ..... E21B 23/08 417/53
2015/0369229 A1* 12/2015 Xiao ..... F04D 1/04 417/54
2017/0022791 A1* 1/2017 Falk ..... E21B 43/121

OTHER PUBLICATIONS

International Search Report and Written Opinion of PCT/US19/33560, dated Sep. 19, 2019.

* cited by examiner

*Primary Examiner* — Connor J Tremarche
(74) *Attorney, Agent, or Firm* — Dunlap Codding, P.C.

(57) ABSTRACT

An electric submersible hydraulic lift pump system is used for removing fluid from a well. The hydraulic lift pump system includes a source of fluid, a tubing string extending from the surface and in fluid communication with the source of fluid, a first pump interposed in the tubing string so the first pump is positioned below the surface and operably arranged to draw fluid from the tubing string upstream of the first pump and to discharge the fluid into the tubing string downstream of the first pump as a power fluid, and a second pump interposed in the tubing string and operably arranged to receive the power fluid from the first pump and be combined with a production fluid to form a return fluid to be discharged into the annulus.

21 Claims, 9 Drawing Sheets

ELECTRIC SUBMERSIBLE HYDRAULIC LIFT PUMP SYSTEM

CROSS-REFERENCE TO RELATED APPLICATIONS

The present application claims the benefit of U.S. Provisional Application Ser. No. 62/675,364, filed May 23, 2018; which is hereby expressly incorporated by reference herein in its entirety.

BACKGROUND

Various downhole well configurations, including vertical, directional, or horizontal, are used in oil and gas production from subterranean formations. Horizontal wells typically comprise a relatively vertical section and a relatively lateral section. These sections are connected by a curved build section, often called a heel. The top of the heel is called "the kick-off point." In almost all cases, the lateral section is the productive target of the well and configured to allow the inflow of fluids (oil/water/gas) from the reservoir into the wellbore.

Horizontal wells can have sub-hydrostatic flowing reservoir pressures that require artificial lift systems to produce the well. However, conventional lift systems, such as submersible pumps, gas lifts, or plunger lifts are not suited for installation deeper than the kick-off point of the well due to their structure. When artificial lift systems are not positioned within the productive target formation, the resulting inflow of fluids becomes inconsistent, with the majority of the produced fluids coming from near the heel section and less coming from the target lateral section.

Hydraulic lift pumps (e.g., jet pumps, reciprocating piston pumps, turbine pumps) have been employed to remove fluid from both vertical wells and horizontal wells. With respect to a jet pump, the length of a typical jet pump ranges from four to six feet allowing it to be easily positioned in the lateral section of the wellbore. In addition, jet pumps have no moving parts, increasing their reliability and ability to handle sand, paraffin, heavy oil, water, gas, or corrosive fluids. Jet pumps generally include a power fluid line operably coupled to the inlet of the jet pump and a return line (e.g., annulus) to receive fluids from a discharge end of the pump. The jet pump includes a venturi or an area of constricted flow. As the pressurized power fluid is forced through the venturi of the jet pump, the power fluid draws in and intermixes with the production fluid. The power fluid and production fluid travel to the surface through the annulus where the production fluid and the power fluid are recovered.

One drawback of conventional hydraulic lift pump systems is they are generally not efficient when compared to other types of artificial lift pumps. One reason for this is the requirement of high pressure power fluid for energizing the pumps. The power fluid is created with a high-pressure pump at the surface. The pump draws fluid from a source at the surface and injects it down the tubing string to the hydraulic lift pump at high pressure. To operate, the hydraulic lift pump may require the power fluid to be at a pressure of 5,000-7,000 psi, for example. The hydraulic lift pump will generally be positioned several thousand feet below the surface (e.g., 5,000 ft. to 15,000 ft.). To overcome friction losses resulting from the power fluid traveling down the tubing string, the power fluid must be pumped at a greater pressure. For example, the power fluid may need to be pressurized to 8,000-9,000 psi depending on depth at the surface to account for the friction losses.

Because of the structural advantages of hydraulic lift pumps, a need exists to overcome the operational inefficiencies of hydraulic lift pumps. It is to such an apparatus and method that the inventive concepts disclosed herein are directed.

BRIEF DESCRIPTION OF THE DRAWINGS

Like reference numerals in the figures represent and refer to the same or similar element or function. Implementations of the inventive concepts disclosed may be better understood when consideration is given to this detailed description thereof. Such description references to the annexed pictorial illustrations, schematics, graphs, drawings, and appendices. In the drawings.

DETAILED DESCRIPTION OF EXEMPLARY EMBODIMENTS

Figure 1:
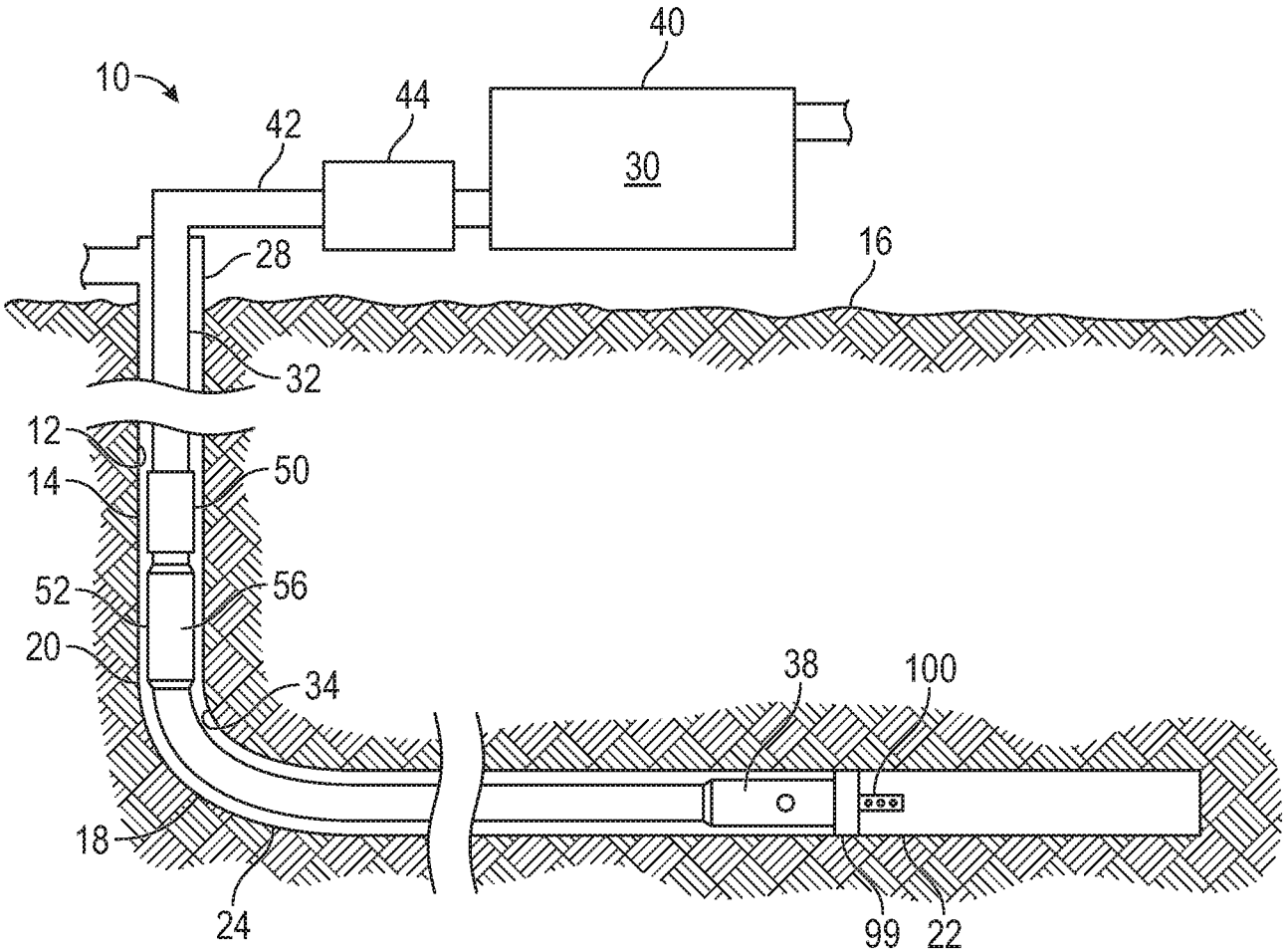
FIG. 1 is a schematic illustration, partially in cross-section, of a hydraulic lift pump system for removing fluid from a well constructed in accordance with the inventive concepts disclosed herein.

The inventive concepts disclosed are generally directed to a hydraulic lift pump system for removing fluid from a well. The hydraulic lift pump system a source of fluid positioned at the surface, a tubing string, a first pump, and a second pump. The tubing string extends from the surface and is in fluid communication with the source of fluid. The first pump has an inlet and an outlet and is interposed in the tubing string so the first pump is positioned below the surface with the inlet positioned upstream of the outlet relative to the source of fluid so the first pump is operably arranged to draw fluid from the tubing string upstream of the first pump and to discharge the fluid into the tubing string downstream of the outlet of the first pump as a power fluid. The second pump has a power fluid inlet, a well fluid inlet, and an outlet. The second pump is interposed in the tubing string so the second pump is in fluid communication with the first pump and the fluid in the well and operably arranged to receive the power fluid from the first pump through the power fluid inlet so the power fluid causes the fluid to be drawn from downhole of the second pump, combined with the power fluid to form a return fluid, and the return fluid to be discharged through the outlet and into the well.

By positioning the first pump below the surface, the fluid entering the first pump is pre-pressurized due to hydrostatic pressure created by the vertical column of fluid. By taking advantage of the hydrostatic pressure of the fluid, the amount of energy required to pressurize the power fluid for energizing the second pump is significantly reduced. Hydrostatic pressure=g (gravity acceleration)×density of fluid× depth. The constant for gravity acceleration is 0.052. The deeper the first pump is positioned in the well, the greater the pressure of the fluid being drawn into the first pump.

Before explaining at least one embodiment of the inventive concepts disclosed, it is to be understood that the inventive concepts are not limited in their application to the details of construction and the arrangement of the components or steps or methodologies in the following description or illustrated in the drawings. The inventive concepts disclosed are capable of other embodiments, such as dual gradient drilling, or of being practiced or carried out in various ways. Also, it is to be understood that the phraseology and terminology employed is for description only and should not be regarded as limiting the inventive concepts disclosed and claimed herein.

In this detailed description of embodiments of the inventive concepts, numerous specific details are set forth in order to provide a more thorough understanding of the inventive concepts. However, it will be apparent to one of ordinary skill in the art that the inventive concepts within the disclosure may be practiced without these specific details. In other instances, well-known features may not be described to avoid unnecessarily complicating the disclosure.

Further, unless stated to the contrary, "or" refers to an inclusive "or" and not to an exclusive "or." For example, a condition A or B is satisfied by anyone of: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concepts disclosed. This description should be read to include one or at least one and the singular also includes the plural unless it is obvious that it is meant otherwise.

As used herein any reference to "one embodiment" or "an embodiment" means that a particular element, feature, structure, or characteristic described in the embodiment is included in at least one embodiment. The appearances of the phrase "in one embodiment" in various places in the specification are not necessarily all referring to the same embodiment.

Referring now to FIG. 1, a hydraulic lift pump system 10 constructed in accordance with the inventive concepts disclosed herein is schematically illustrated. The hydraulic lift pump system 10 is for removing fluid, such as oil and water, from a well 12. In one embodiment, the well 12 is a horizontal well with a vertical section 14 extending downwardly from a surface 16, a build curve 18 angling downwardly from a lower end 20 of the vertical section 14, and a lateral section 22 extending laterally from a lower end 24 of the build curve 18. The well 12 is lined with a casing (not shown) extending down from a wellhead 28. The casing provides a permanent borehole through which production operations may be conducted. The casing is affixed to a wellbore of the well 12 in a conventional manner, such as by cement (not shown), and is provided with perforations (not shown) open to a producing subterranean formation.

The hydraulic lift pump system 10 includes a source of fluid 30 positioned at the surface 16, a tubing string 32 positioned in the well 12 and forming an annulus 34 with the well 12, a first pump 36 interposed in the tubing string 32 so the first pump 36 is positioned below the surface 16 with the first pump 36 operably arranged to draw fluid from the tubing string 32 uphole of the first pump 36 and discharge the fluid downhole of the first pump 36 as a power fluid, and a second pump 38 interposed in the tubing string 32 so the second pump 38 is positioned in the lateral section 22 of the well 12 and operably arranged to receive the power fluid from the first pump 36 in a way that the power fluid causes production fluid to be drawn from downhole of the second pump 38, combined with the power fluid to form a return fluid, and the return fluid to be discharged from the second pump 38 and into the annulus 34.

Positioning the first pump 36 in the well 12 below the surface 16 allows the first pump 36 to receive fluid from the surface that has been gravity fed. As such, the fluid entering the first pump 36 has a pressure at least equal to the hydrostatic pressure created by the vertical column of fluid above the first pump 36.

The source of fluid 30 may be, for example, one or more tanks 40 containing a fluid, such as water or oil. The source of fluid 30 is fluidically connected to the tubing string 32 with a feed line 42. A transfer pump 44 is interposed in the feed line 42 to transfer fluid from the tank 40 to the tubing string 32 so a volume of fluid is provided uphole of the first pump 36. The transfer pump 44 is optional and may be any suitable pump capable of transferring fluid from the tank 40 to the tubing string 32 where the fluid is gravity fed down the tubing string 32 to the first pump 36. The transfer pump 44 may be a diaphragm pump, a centrifugal pump, or a reciprocating pump. Other pumps are Rotary vane pumps, screw pumps, bent axis pumps, inline axial piston pumps and swashplate principle, radial piston pumps, peristaltic pumps, gear pumps, turbine pumps, and intensifier pumps.

The tubing string 32 provides fluid communication between source of fluid 30 and the producing subterranean formation so that the fluid can be transported down the tubing string 32 to the first pump 36, pressurized by the first pump 36, transported to the second pump 38, mixed with the formation fluid, and transported back to the surface 16 via the annulus 34. The tubing string 32 may be formed of joints of pipe or coiled tubing.

Figure 2:
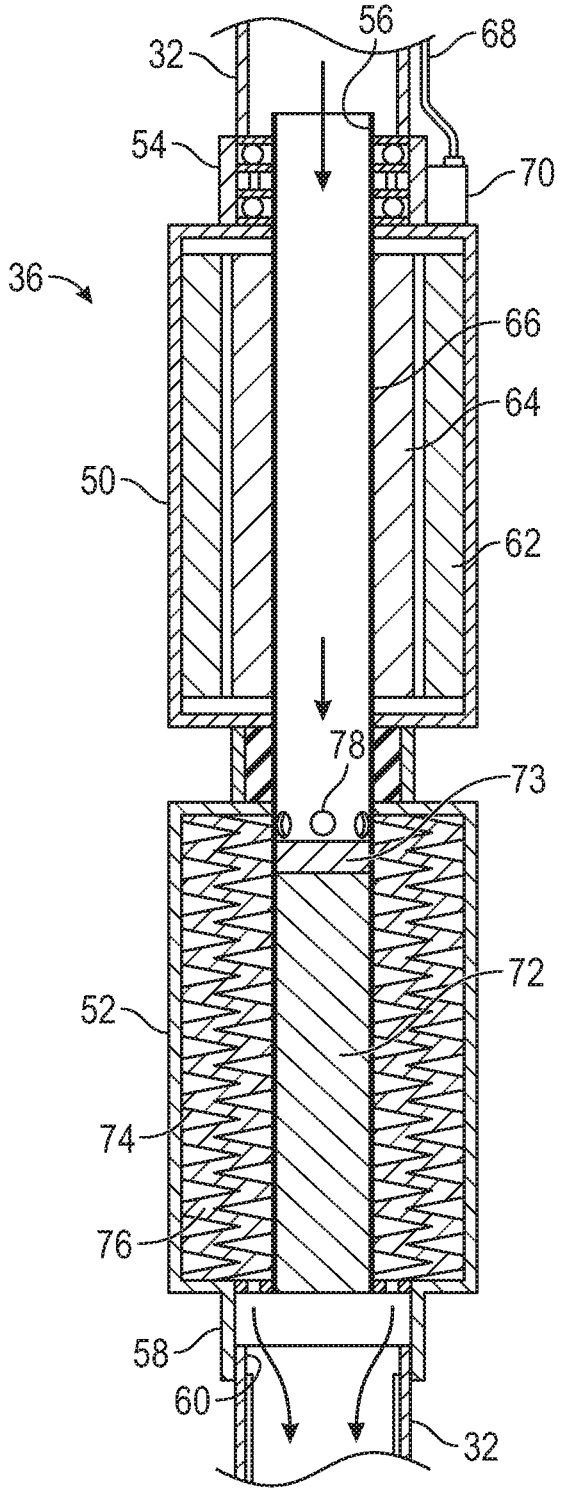
FIG. 2 is cross-sectional view of an exemplary jet pump used in the hydraulic lift pump system.

The first pump 36 may be an electric submersible pump. Electric submersible pumps may have multiple components depending on the environment they are being used. In the illustrated embodiment, the first pump 36 includes two principal elements—an electric motor 50 and a pump 52. As shown in FIGS. 1 and 2, the first pump 36 is arranged with the electric motor 50 positioned uphole of the pump 52. To this end, an upper end 54 of the electric motor 50 defines an inlet 56 and a lower end 58 of the pump 52 defines an outlet 60. The upper end 54 of the electric motor 50 may be threaded to be connected to an uphole portion of the tubing string 32, and the lower end 58 of the pump 52 is threaded to be connected to a downhole portion of the tubing string 32.

As illustrated in FIG. 2, the electric motor 50 has an annular stator 62, a concentric rotor 64, and a drive shaft 66.

To enable fluid to be transferred through the electric motor 50, the drive shaft 66 is hollow. The rotor 64 is connected to the drive shaft 66. An electrical conductor cable 68 provides power to the electric motor 50 through a terminal box 70.

The pump 52 has a drive shaft 72, which is connected to the drive shaft 66 with a coupling 73. The drive shaft 72 of the pump 52 is connected to pump elements 74, such as impellers 76. The drive shaft 66 of the electric motor 50 is connected to the drive shaft 72 of the pump 52 so the fluid passing through the hollow drive shaft 66 passes into the pump 52. In one embodiment, the hollow drive shaft 66 is provided with ports or flow passages 78 for passing fluid from the hollow drive shaft 66 to the pump 52. When in the pump 52, the pump elements 74 pressurize the fluid, which is discharged from the outlet 60 as a power fluid.

In another embodiment, the drive shaft 66 and the drive shaft 72 may be formed has a single piece with a hollow section and a solid section. Also, the first pump 36 may be arranged with the pump 52 positioned uphole of the electric motor 50. In this embodiment, an upper end of the pump 52 defines the inlet and a lower end of the electric motor 50 defines the outlet.

The pump elements 72 are shown in FIG. 2 to be impellers of a centrifugal pump. However, as described above, the pump 52 may be any type of pump suitable for pressurizing fluid in a downhole environment.

Figure 3:
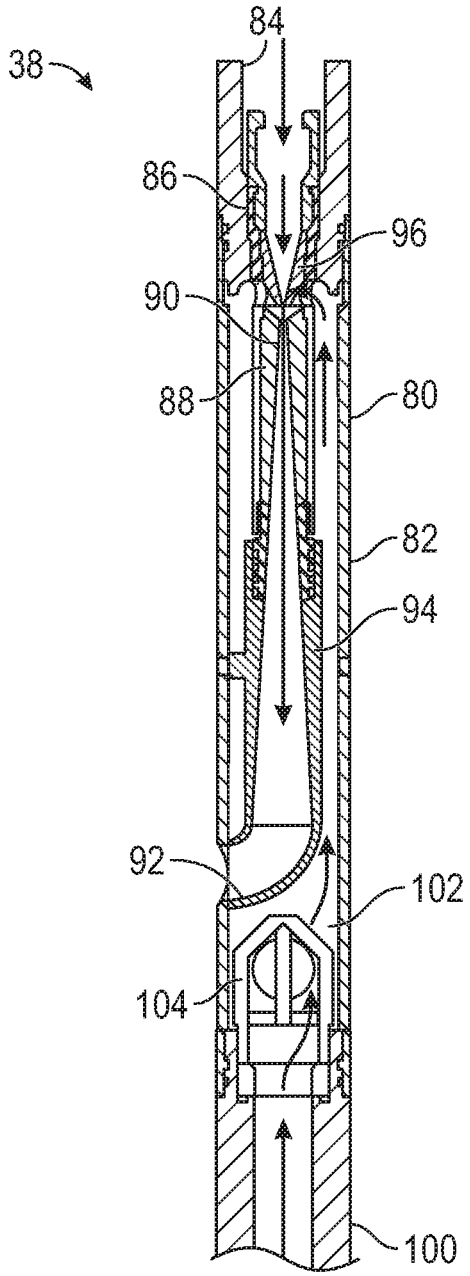
FIG. 3 is a cross-sectional view of an exemplary jet pump used in the hydraulic lift pump system.

In the illustrated embodiment of FIG. 3, the second pump 38 is a hydraulic jet pump 80, which operates off of the power fluid formed by the first pump 36. FIG. 3 illustrates one exemplary jet pump, but it should be appreciated that a variety jet pump designs may be used. The jet pump 80 has a body 82 having an uphole end and a downhole end. The uphole end of the body 82 is fluidly connected to the tubing string 32 so power fluid may flow into the body 82 via power fluid inlet 84. The body 20 further has a carrier seat 86 adjacent the uphole end, in fluid communication with power fluid inlet 84, fluidly connecting between the tubing string 32, the carrier seat 86, and to a throat 88 supported below the seat 86. The throat 88 has a narrow inlet 90 and an outlet 92, which is fluidly connecting between a diffuser 94 and the annulus 34. A venturi 96 is releasably supported within the carrier seat 86, forming a gap between the carrier seat 86 and the throat 88.

Referring to FIGS. 1 and 3, an annular seal 99 (e.g., packer) may be provided at the downhole end of the jet pump 80 to force all the production fluids through the jet pump 80. In other embodiments, the seal 99 may be omitted to permit a portion of the production fluids to bypass the jet pump 80. A production fluid intake 100, proximate the downhole end, receives production fluid entering the well 12 through perforations and directs the production fluid to an axially extending production conduit 102 within the body 82. The production fluid conduit 102 is fluidly connected between the intake 100 and the carrier seat 86 and the throat 88. A one-way valve 104, typically a standing valve, may be positioned in the production fluid conduit 102 adjacent the intake 100 for permitting production fluid to enter the production conduit 102 and blocking flow therefrom to below the one-way valve 104.

With reference to FIGS. 1-3, in operation the tubing string 32 is run into the well 12 with the first pump 36 interposed in the tubing string 32 so the first pump 36 is positioned between the surface 16 and the lower end 20 of the vertical section 14 and with the first pump operably arranged to draw fluid from the tubing string 32 uphole of the first pump 36 and discharge the power fluid downhole of the first pump 36. The second pump 38 is interposed in the tubing string 32 so the second pump 38 is positioned in the lateral section 22 of the well 12 and operably arranged to receive the power fluid from the first pump 36 in a way that the power fluid causes production fluid to be drawn from downhole of the second pump 38, combined with the power fluid to form a return fluid, and the return fluid to be discharged from the second pump 38 into the annulus 34.

Power fluid flows from the tubing string 32 into the venturi 96 via the power fluid inlet 84. The power fluid flows past the carrier seat 86 (via ports) and the gap formed between the carrier seat 86 and the throat 88, creating a lower pressure. The lower pressure condition forms suction at the carrier seat 86 which induces production fluid to flow into the production fluid inlet 100, through the one-way valve 104, the production conduit 102, and the carrier seat 86 into the throat 88. The production fluid combines with the power fluid in the throat 88, which acts as a mixing tube to form a return fluid. As the return fluid reaches the wider end of the throat 88 and the diffuser 94, the increased cross-sectional area, relative to the venturi 96 and the narrow inlet 90 of the throat 88, acts to increase the pressure, providing impetus for discharging the return fluid from the outlet 92 and lifting the return fluid to the surface 16 via the annulus 34. In another embodiment, the tubing string 32 may be part of a concentric tubing string so that the tubing string 32 forms an annulus with a second tubing string or a parallel tubing string so that the tubing string 32 is connected to a second tubing string.

To take advantage of the hydrostatic pressure of the vertical column of the fluid in the tubing string 32 uphole of the first pump 36, the first pump 36 can be positioned anywhere between the surface 16 and the lower end 20 of the vertical section 14. The closer to the lower end 20 of the vertical section 14 the first pump 36 is positioned, the greater the hydrostatic pressure of the vertical column of fluid that will enter the first pump 36.

Figure 4:
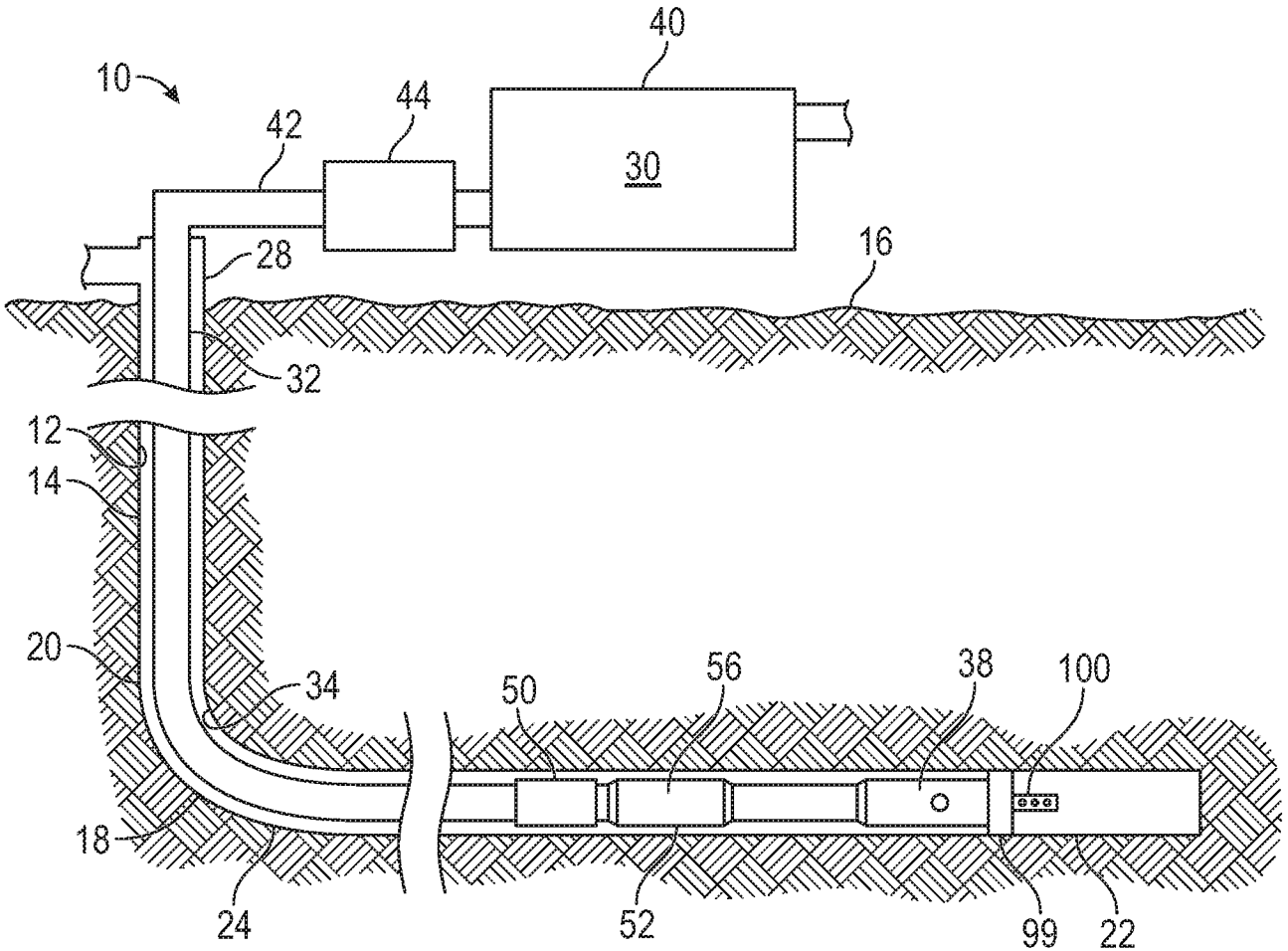
FIG. 4 is a schematic illustration, partially in cross-section, of another embodiment of a hydraulic lift pump system for removing fluid from a well constructed in accordance with the inventive concepts disclosed herein.

Referring to FIG. 4, if the length of the first pump 36 and the radius of the build curve 18 permit, the first pump 36 can be positioned in the lateral section 22 of the well 12 (FIG. 4), or in the build curve 18 (not illustrated).

Figure 5:
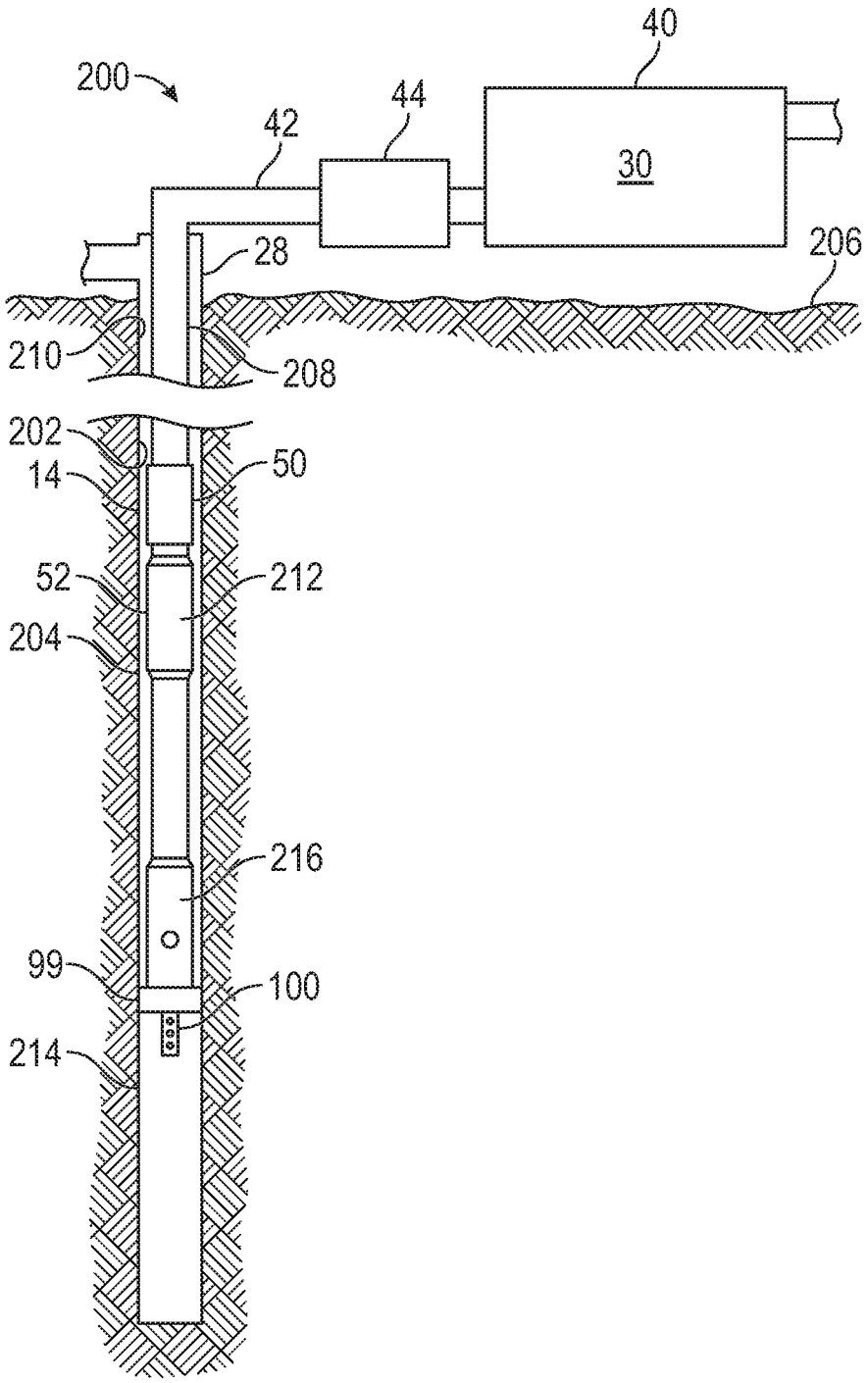
FIG. 5 is a schematic illustration, partially in cross-section, of another embodiment of a hydraulic lift pump system for removing fluid from a well constructed in accordance with the inventive concepts disclosed herein.

Referring now to FIG. 5, another embodiment of a hydraulic lift pump system 200 constructed in accordance with the inventive concepts disclosed herein is illustrated. The hydraulic lift pump system 200 is similar to the hydraulic lift pump system 10 except the hydraulic lift pump system 200 is for removing fluid, such as oil and water, from a well 202. The well 202 is a vertical well with a vertical section 204 extending downwardly from a surface 206. The well 202 is lined with a casing (not shown) extending down from a wellhead 28. The casing provides a permanent borehole through which production operations may be conducted. The casing is affixed in the well 202 in a conventional manner, such as by cement (not shown), and is provided with perforations (not shown) open to a producing subterranean formation.

The hydraulic lift pump system 200 includes a source of fluid 30 positioned at the surface 206, a tubing string 208 positioned in the well 202 and forming an annulus 210 with the well 202, a first pump 212 interposed in the tubing string 208 so the first pump 212 is positioned between the surface 206 and a lower end 214 of the vertical section 204 with the first pump 212 operably arranged to draw fluid from the tubing string 208 upstream of the first pump 212 and discharge the fluid downhole of the first pump 212 as a power fluid, and a second pump 216 interposed in the tubing string 208 so the second pump 216 is positioned near a lower end of the vertical section 204 of the well 202 and operably arranged to receive the power fluid from the first pump 212 in a way that the power fluid causes production fluid to be drawn from downhole of the second pump 216, combined with the power fluid to form a return fluid, and the return fluid to be discharged from the second pump 216 and into the annulus 210.

The first pump 212 and the second pump 216 are similar to the first pump 36 and the second pump 38 described above in reference to the hydraulic lift pump system 10. The hydraulic lift pump system 200 differs from the hydraulic lift pump system 10 being employed in a vertical well where the first pump 212 and the second pump 216 are positioned in the vertical section 210 of the well 202.

Figure 6A:
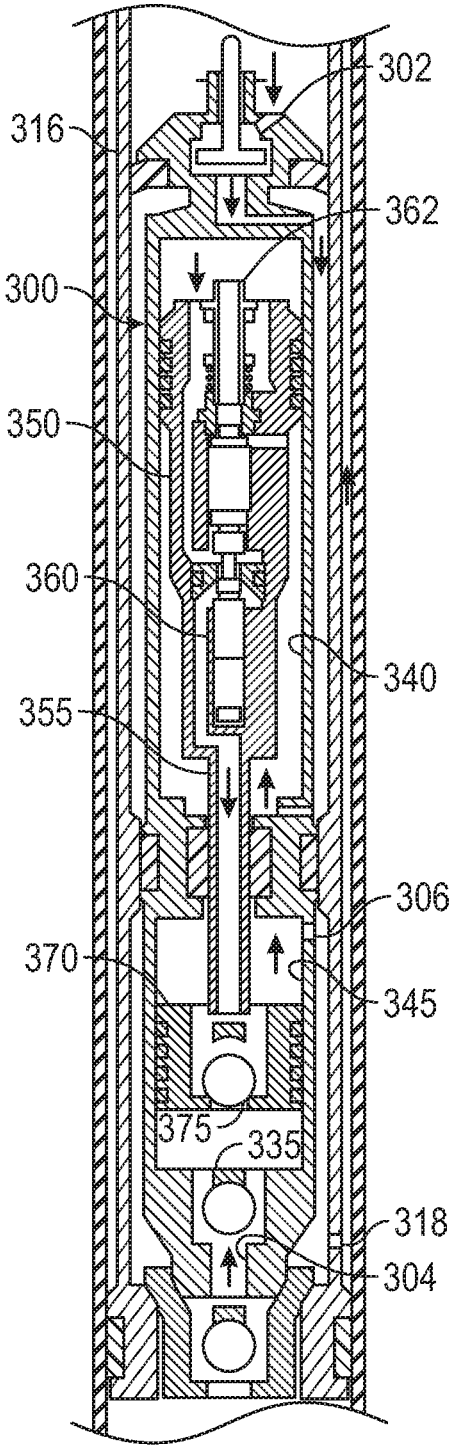
FIG. 6A is a cross-sectional view of an exemplary reciprocating piston pump that can be used in the hydraulic lift pump systems of FIGS. 1, 4, and 5 shown in an upstroke position.
Figure 6B:
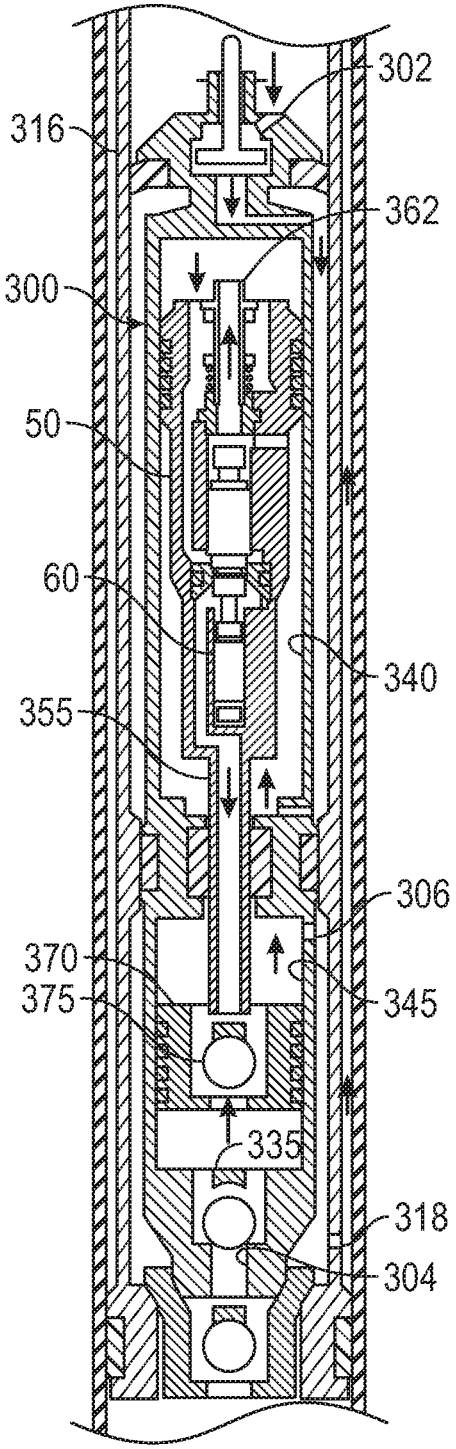
FIG. 6B is a cross-sectional view of the reciprocating piston pump of FIG. 6A shown in a downstroke position.

FIGS. 6A and 6B illustrate another embodiment of a second pump 300 that can be employed in the hydraulic lift pump system 10 and the hydraulic lift pump system 200. The second pump 300 is a hydraulic reciprocating piston pump and is shown interposed in a tubing string 316 so the second pump 300 is positioned to receive the power fluid from the first pump 36 or 212 in a way that the power fluid causes production fluid to be drawn from downhole of the second pump 300, combined with the power fluid to form a return fluid, and the return fluid to be discharged from the second pump 300 and into the annulus.

Power fluid from the first pump 32 or 212 enters the pump's inlet 302 and operates the pump 300 internally between upstrokes and downstrokes. In its upstroke, the pump 300 draws production fluid downhole of the second pump 300 into the pump's well fluid inlet 304. Subsequently operated in its downstroke, the pump 300 discharges the produced fluid and spent power fluid into the tubing string 32 via ports 306. The discharged fluid then passes through ports 318 in the tubing string 32 and into the annulus where it travels to the surface.

The pump 300 has an engine piston 350, a reversing valve 360, and a pump piston 370. A rod 355 interconnects the engine piston 350 to the pump piston 370 so that the two pistons 350/370 move together in the pump 300. Power fluid used to actuate the pump 300 enters the pump 300 via inlet 302 and travels into an engine barrel 340 via ports 342. Inside the barrel 340, the power fluid acts on the engine piston 350. The reversing valve 360 within the engine piston 350 alternately directs the power fluid above and below the piston 350, causing the piston 350 to reciprocate within the engine's barrel 340. In the upstroke shown in FIG. 6A, mechanical force from a push rod 362 initiates the shifting of the reversing valve 360 downward, after which hydraulic force from the fluid continues to shift the valve 360 downward. This shifting diverts the power fluid to the volume of the barrel 340 above the engine piston 350, and the buildup of power fluid causes the engine piston 350 to move downward in the engine's barrel 340. In the downstroke shown in FIG. 6B, mechanical force and then hydraulic force shift the reversing valve 360 upward. The power fluid fills the barrel's volume below the engine piston 350 and causes the piston 350 to move upward.

The pump piston 370 connected to the engine piston 350 by rod 355 moves in tandem with the engine piston 350. When moved, the pump piston 370 operates similar to a conventional sucker rod pump. At the start of the upstroke shown in FIG. 6A, a traveling valve 375 closes, and a standing valve 335 opens. The fluid in the piston barrel 345 above the pump piston 370 is then displaced out of the pump's barrel 345 via port 306 as the pump piston 370 continues the upstroke. The fluid passes out tubing port 318 and to the annulus.

The upstroke reduces the pressure in the barrel 345 below the pump piston 370 so that the resulting suction allows production fluid to enter the barrel 345 through the open standing valve 334. At the start of the downstroke shown in FIG. 6B, the traveling valve 375 opens, and the standing valve 334 closes. This permits the production fluid that entered the lower part of the barrel 345 below the pump piston 370 to move above the piston 370 through the open traveling valve 375. In this way, this moved production fluid can be discharged to the surface on the next upstroke.

The pump 300 is further described in U.S. Pat. No. 8,303,272, which is hereby expressly incorporated herein by reference. It should be understood that the pump 300 shown in FIGS. 6A and 6B is only one example of a reciprocating piston pump that can be used in the hydraulic lift pump systems described herein.

Figure 7:
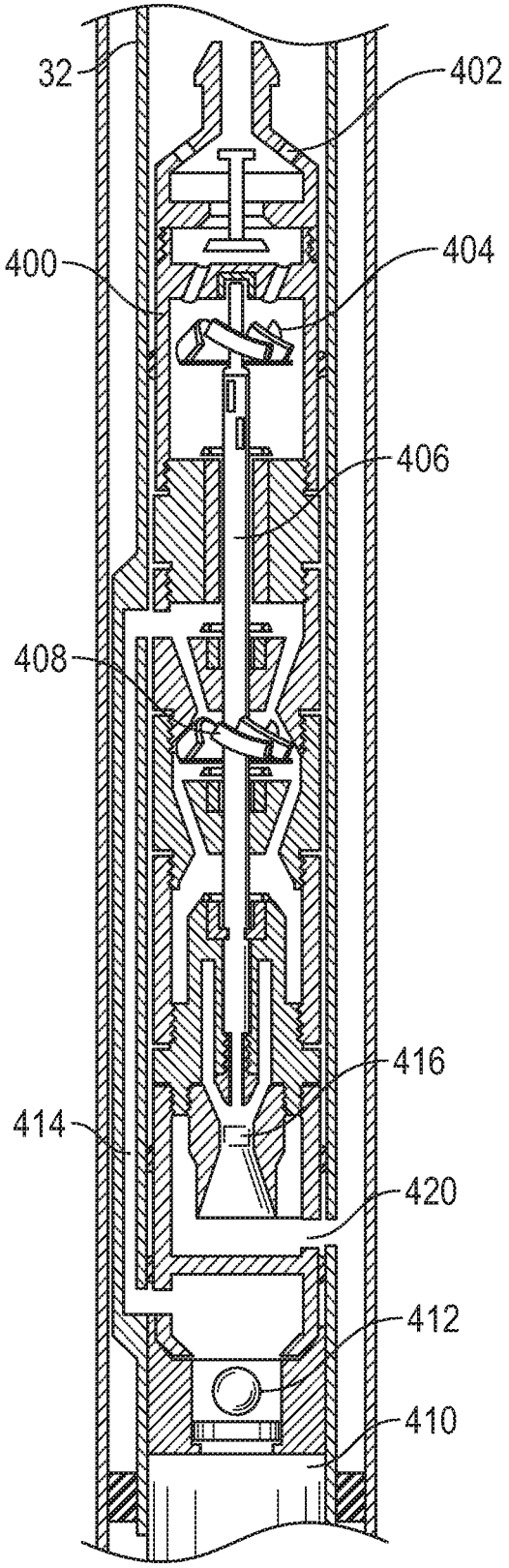
FIG. 7 is a cross-sectional view of an exemplary hydraulic turbine pump that can be used in the hydraulic lift pump systems of FIGS. 1, 4, and 5.

FIG. 7 illustrates yet another embodiment of a second pump 400 that can be employed in the hydraulic lift pump systems 10 and 200. The second pump 400 is a hydraulic turbine pump and is interposed in the tubing string (e.g., tubing string 32) so the second pump 400 is positioned to receive the power fluid from the first pump 36 or 212 in a way that the power fluid causes production fluid to be drawn from downhole of the second pump 400, combined with the power fluid to form a return fluid, and the return fluid to be discharged from the second pump 400 and into the annulus.

Power fluid from the first pump 32 or 212 enters the pump's inlet 402 and causes a first drive turbine 404 to rotate a shaft 406 which rotates a second pump turbine 408. Rotation of the second pump turbine 408 creates a lower pressure. The lower pressure condition forms suction which induces production fluid to flow into the production fluid inlet 410, through the one-way valve 412, the production conduit 414, and combines with the power fluid in a mixing chamber 416 to form a return fluid. The return fluid is discharged to the annulus via an outlet 420.

The pump 400 is further described in U.S. Pat. No. 4,003,678, which is hereby expressly incorporated herein by reference. It should be understood that the pump 400 shown in FIG. 7 is only one example of a hydraulic piston pump that can be used in the hydraulic lift pump systems described herein. For example, the pump 400 may include two or more drive turbines and two or more pump turbines.

Figure 8:
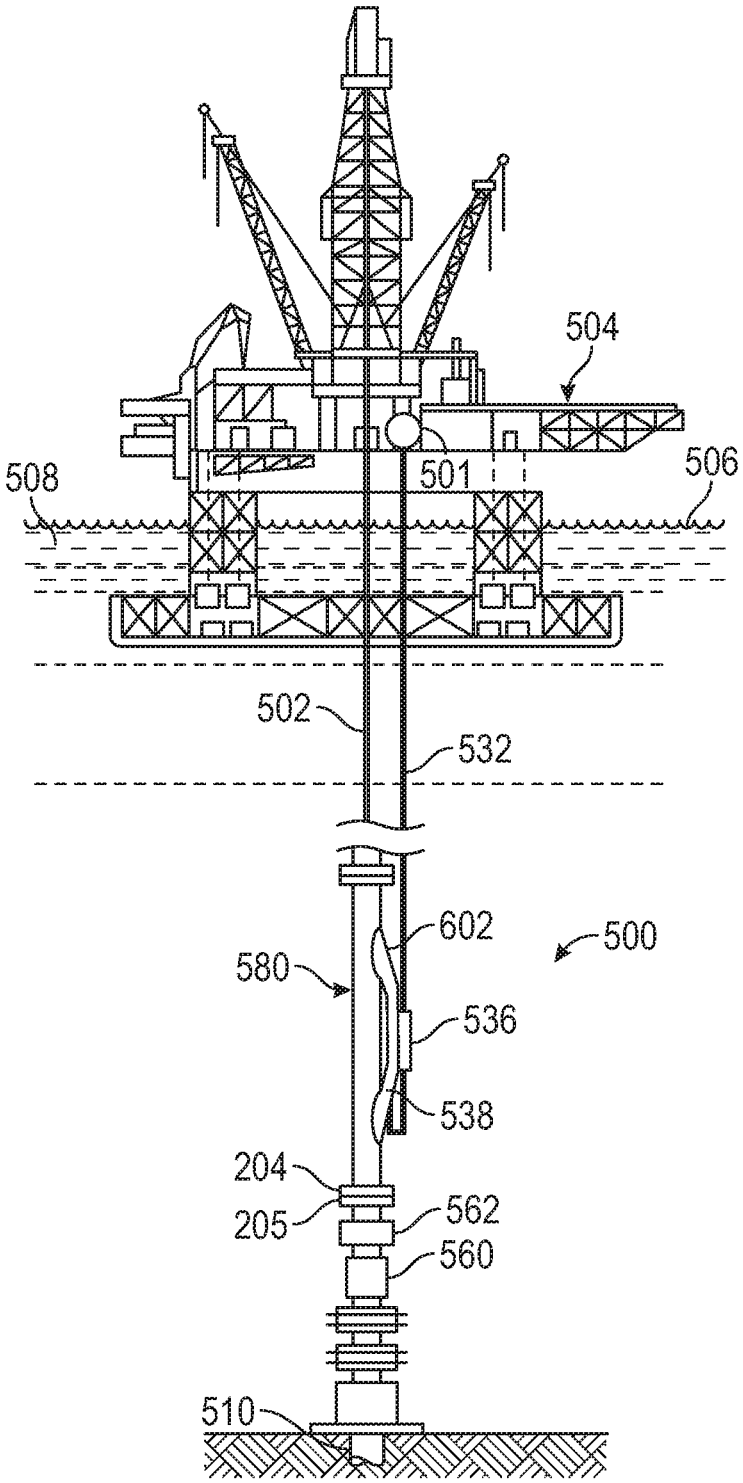
FIG. 8 is a schematic illustration of another embodiment of a hydraulic lift pump system for removing fluid from a well constructed in accordance with the inventive concepts disclosed herein.
Figure 9:
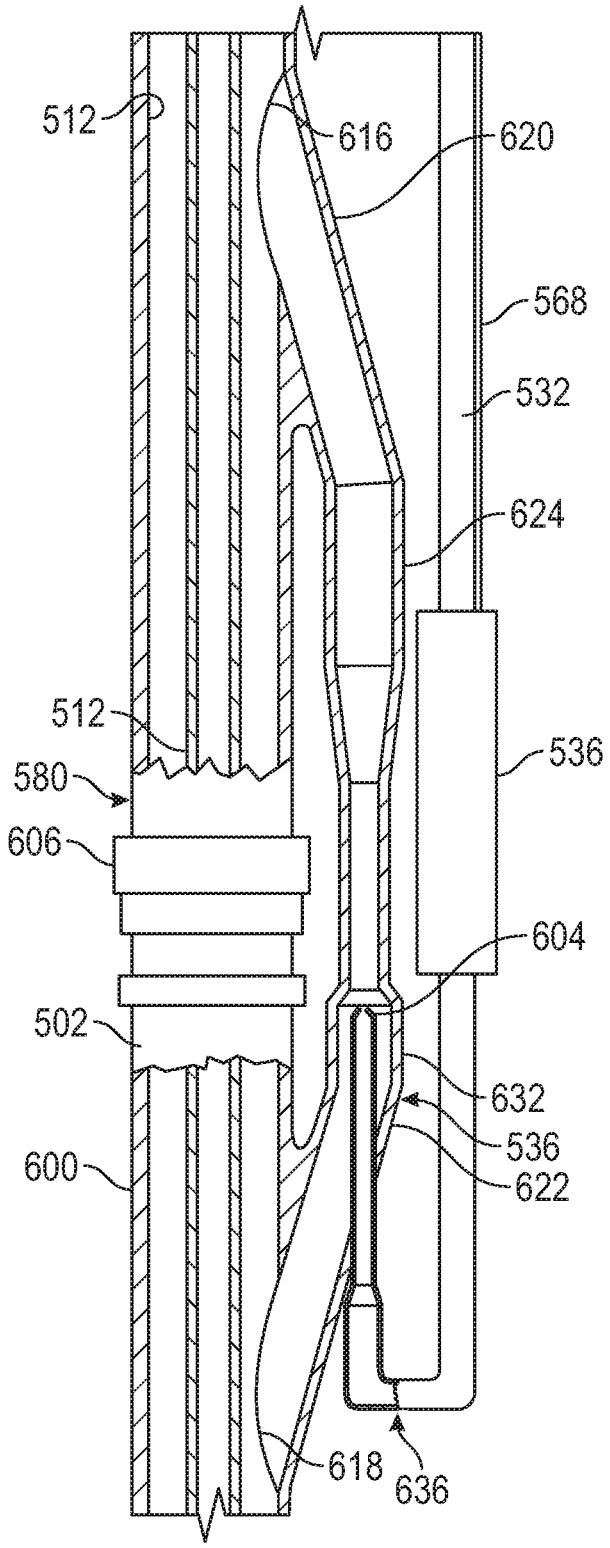
FIG. 9 is a cross-sectional view of a hydraulic lift pump used in the hydraulic lift pump system of FIG. 8.

FIGS. 8 and 9 illustrate another embodiment of a hydraulic lift pump system 500 constructed in accordance with the inventive concepts disclosed herein. As described in U.S. Pat. No. 8,403,059, which is hereby expressly incorporated herein by reference, hydraulic lift pumps have been used to remove fluid in dual gradient drilling operations. In offshore drilling, a riser 502 extends from a drilling platform 504 at the surface 506 of the water 508 to a wellbore 510. A drill bit (not shown) is affixed to a drill string 512 (FIG. 9) that travels inside the riser 502. The hydrostatic head of the drilling fluid (i.e., drilling mud) returning to the surface 506 in an annulus 512 of the riser 502 creates high well bore pressures. The high well bore pressure can create a number of problems, including damaging the formation. To overcome these problems, the hydrostatic weight of the drilling fluid returning to the surface through the riser can be lowered by introducing another fluid, such as seawater, to the drilling fluid in the annulus 512 of the riser 502 at the lower end of the riser 502.

The hydraulic lift pump system 500 includes a source of fluid 501 (e.g., seawater) positioned at the surface 506, a tubing string 532 positioned exterior to the riser 502, a first pump 536 interposed in the tubing string 532 so the first pump 536 is positioned below the surface 506 with the first pump 536 operably arranged to draw fluid from the tubing string 532 upstream of the first pump 536 and discharge the fluid downstream of the first pump 536 as a power fluid, and a second pump 538 interposed in the tubing string 532 so the second pump 538 is in fluid communication with the riser 502 and operably arranged to receive the power fluid from the first pump 536 in a way that the power fluid causes production fluid to be drawn from downhole of the second pump 538, combined with the power fluid to form a return fluid, and the return fluid to be discharged from the second pump 538 and into the annulus 512.

The first pump 536 is similar to the first pump 36 described above in reference to the hydraulic lift pump system 10. An electrical conductor cable 568 provides power to the first pump 536. Positioning the first pump 536 below the surface 516 allows the first pump 536 to receive fluid from the surface that has been gravity fed. As such, the fluid entering the first pump 536 has a pressure equal to the hydrostatic pressure created by the vertical column of fluid above the first pump 536.

The second pump 538 is shown to be a hydraulic jet pump assembly 580 that operates off of the power fluid formed by the first pump 536. FIGS. 8 and 9 illustrate one exemplary jet pump assembly, but it should be appreciated that a variety jet pump designs may be used.

The modified riser joint which incorporates one or more jet pump assemblies 580 may be placed anywhere in the riser, including just above blowout preventer stack 560 and a flex joint 562. The jet pump assembly 580 comprises a jet pump riser joint 600 incorporated as a section of the riser 502, a bypass conduit 602, and a nozzle 604 fluidically connected to the first pump 536. A seal assembly 606, such as an annular BOP, is positioned in the jet pump riser joint 600 and receives the drilling string in a way that drilling fluids returning to the surface via the annulus 512 will pass through the bypass conduit 602. The bypass conduit 602 may be affixed to the jet pump riser joint 600 at a conduit exhaust joint 616 and at a conduit intake joint 618. In an embodiment, the bypass conduit 602 may be an integral part of the jet pump riser joint 600. In another embodiment, the bypass conduit 602 may be affixed to the jet pump riser joint by modification of a riser joint.

The bypass conduit 602 may have a conduit exhaust angle section 320 extending downward and away from the jet pump riser joint 600. The conduit exhaust angle section 620 joins the conduit exhaust section 624. The conduit exhaust section 624 may be approximately parallel to riser joint 600. The conduit exhaust section 624 joins a conduit diffuser section 626. The conduit diffuser section 626 may have a diffuser first diameter 625 where the conduit diffuser section 626 joins the conduit exhaust section 624. The conduit diffuser section 626 joins the conduit mixing section 628. The conduit diffuser section 626 may have a conduit second diffuser diameter 627 where the conduit diffuser section 626 joins the conduit mixing section 628. The conduit diffuser first diameter 625 may be approximately twice the length of the diffuser second diameter 627.

The conduit 602 may have a conduit intake angle section 622 extending upward and away from the riser joint 600. The conduit intake angle section 622 joins a conduit entrance section 632. The conduit entrance section 632 joins a conduit nozzle section 630. The conduit nozzle section 630 may have a conduit nozzle first diameter 631 where the conduit nozzle section 630 joins the conduit entrance section 632. The conduit nozzle section 630 may have a conduit nozzle second diameter 629 where the conduit nozzle section 630 joins the conduit mixing section 628. The conduit nozzle first diameter 631 may be greater than conduit nozzle second diameter 629.

The tubing string 532 extends downward from platform 510 shown in FIG. 8. The nozzle is connected to a distal end of the tubing string 532 and extends through the bypass conduit 602 so the nozzle is positioned in the bypass conduit.

In operation, the seal assembly 606 causes the drilling fluids returning to the surface via the annulus 512 to pass through the bypass conduit 602. The nozzle 604 ejects a fluid from the source of fluid 501 into the bypass conduit 602 so the fluid mixes with the drilling fluids to produce a return fluid that returns to the surface. To take advantage of the hydrostatic pressure of the vertical column of the fluid in the tubing string 532 uphole of the first pump 536, the first pump 536 can be positioned anywhere between the surface 516 and the second pump 538. The closer to the second pump 538 that the first pump 536 is positioned, the greater the hydrostatic pressure of the vertical column of fluid that will enter the first pump 536.

From the above description, it is clear that the inventive concepts disclosed herein is well adapted to carry out the objects and to attain the advantages mentioned and those inherent in the inventive concepts disclosed herein. While preferred embodiments of the inventive concepts disclosed have been described for this disclosure, it will be understood that numerous changes may be made which will readily suggest themselves to those skilled in the art and which are accomplished within the scope and coverage of the inventive concepts disclosed and claimed herein.

What is claimed is:

1. A hydraulic lift pump system for removing fluid from a well extending downwardly from a surface, the hydraulic lift pump system comprising:

a source of fluid positioned at the surface;

a tubing string extending downwardly from the surface into the well and being in fluid communication with the source of fluid;

a first pump having an inlet and an outlet and interposed in the tubing string so the first pump is positioned below the surface with the inlet positioned uphole of the outlet relative to the source of fluid so the first pump is operably arranged to draw fluid from the tubing string uphole of the first pump and to discharge the fluid into the tubing string downhole of the outlet of the first pump as a power fluid, the first pump being an electric submersible pump with an electric motor and a centrifugal pump operably connected to the electric motor, the motor positioned uphole of the centrifugal pump and having a hollow drive shaft connected to the centrifugal pump, the hollow drive shaft defining a fluid flow path from the inlet, through the motor, and into the pump, the centrifugal pump being in fluid communication with the outlet; and a second pump having a power fluid inlet, a well fluid inlet, and an outlet, the second pump interposed in the tubing string downhole of the first pump so the second pump is in fluid communication with the first pump and the fluid in the well and operably arranged to receive the power fluid from the first pump through the power fluid inlet so the power fluid causes the fluid to be drawn from downhole of the second pump, combined with the power fluid to form a return fluid, and the return fluid to be discharged through the outlet and into the well.

2. The hydraulic lift pump system of claim 1, wherein the tubing string is positioned in the well to form an annulus with the well, and wherein the return fluid is discharged into the annulus.

3. The hydraulic lift pump system of claim 1, wherein the well has at least a vertical section, and wherein the first pump and the second pump are positioned in the vertical section.

4. The hydraulic lift pump system of claim 3, wherein the tubing string is positioned in the well to form an annulus with the well, and wherein the return fluid is discharged into the annulus.

5. The hydraulic lift pump system of claim 1, wherein the well has a vertical section extending downwardly from the surface, a build curve angling downwardly from the lower end of the vertical section, and a lateral section extending laterally from a lower end of the build curve, and wherein the first pump is positioned at a lower end of the vertical section and the second pump is positioned in the lateral section of the well.

6. The hydraulic lift pump system of claim 5, wherein the tubing string forms an annulus with the well, and wherein the return fluid is discharged into the annulus.

7. The hydraulic lift pump system of claim 1, wherein the well has a vertical section extending downwardly from the surface, a build curve angling downwardly from the lower end of the vertical section, and a lateral section extending laterally from a lower end of the build curve, and wherein the first pump and the second pump are positioned in the lateral section of the well.

8. The hydraulic lift pump system of claim 1, wherein the well includes a riser, and wherein the tubing string is exterior to the riser and extends from the surface to a lower end of the riser.

9. The hydraulic lift pump system of claim 8, wherein the second pump is connected to the riser so the return fluid is discharged into the riser.

10. The hydraulic lift pump system of claim 1, where the second pump is a hydraulic jet pump.

11. The hydraulic lift pump system of claim 1, where the second pump is a hydraulic reciprocating piston pump.

12. The hydraulic lift pump system of claim 1, where the second pump is a hydraulic turbine pump.

13. A method of removing fluid from a well extending downwardly from a surface, the method comprising:

extending a tubing string into the well from the surface with the tubing string being in fluid communication with a fluid source at the surface, a first pump having an inlet and an outlet interposed in the tubing string so the first pump is positioned below the surface with the inlet positioned uphole of the outlet relative to the fluid source and a second pump having a power fluid inlet, a well fluid inlet, and an outlet interposed in the tubing string so the second pump is in fluid communication with the first pump and the fluid in the well, the first pump being an electric submersible pump with an electric motor and a centrifugal pump operably connected to the electric motor, the motor positioned uphole of the centrifugal pump and having a hollow drive shaft connected to the centrifugal pump, the hollow drive shaft defining a fluid flow path from the inlet, through the motor, and into the pump, the centrifugal pump being in fluid communication with the outlet;

passing fluid from the fluid source into the tubing string uphole of the first pump; and activating the first pump to draw fluid from the tubing string uphole of the first pump and to discharge the fluid from the outlet of the first pump into the tubing string downhole of the first pump as a power fluid so the power fluid is passed through the power fluid inlet of the second pump so the power fluid causes fluid to be drawn from downhole of the second pump, combined with the power fluid to form a return fluid, and the return fluid to be discharged through the outlet and into the well.

14. The method of claim 13, wherein the tubing string is positioned in the well to form an annulus with the well, and wherein the return fluid is discharged into the annulus.

15. The method of claim 13, wherein the well has at least a vertical section, and wherein the first pump and the second pump are positioned in the vertical section.

16. The method of claim 15, wherein the tubing string is positioned in the well to form an annulus with the well, and wherein the return fluid is discharged into the annulus.

17. The method of claim 13, wherein the well has a vertical section extending downwardly from the surface, a build curve angling downwardly from the lower end of the vertical section, and a lateral section extending laterally from a lower end of the build curve, and wherein the first pump is positioned at a lower end of the vertical section and the second pump is positioned in the lateral section of the well.

18. The method of claim 17, wherein the tubing string forms an annulus with the well, and wherein the return fluid is discharged into the annulus.

19. The method of claim 13, wherein the well has a vertical section extending downwardly from the surface, a build curve angling downwardly from the lower end of the vertical section, and a lateral section extending laterally from a lower end of the build curve, and wherein the first pump and the second pump are positioned in the lateral section of the well.

20. The method of claim 13, wherein the well includes a riser, and wherein the tubing string is exterior to the riser and extends from the surface to a lower end of the riser.

21. The method of claim 20, wherein the second pump is connected to the riser so the return fluid is discharged into the riser.

* * * * *